US006433551B1

(12) United States Patent
Shaland et al.

(10) Patent No.: US 6,433,551 B1
(45) Date of Patent: Aug. 13, 2002

(54) ENGINE TIMING MEASUREMENT DEVICE WITH RPM AND ADVANCE DISPLAYS AND FLASHLIGHT FUNCTION

(75) Inventors: Alexander Shaland, Lyndhurst; Matt Koran, Strongsville, both of OH (US)

(73) Assignee: Actron Manufacturing Company, Cleveland, OH (US)

( * ) Notice: Subject to any disclaimer, the term of this patent is extended or adjusted under 35 U.S.C. 154(b) by 0 days.

(21) Appl. No.: 09/175,064

(22) Filed: Oct. 19, 1998

(51) Int. Cl.[7] ..... F02P 17/00; G81R 31/00

(52) U.S. Cl. ..... 324/395; 324/506

(58) Field of Search ..... 324/395, 392, 324/391, 393, 394, 396, 506, 542, 556, 97

(56) References Cited

U.S. PATENT DOCUMENTS 2,787,760 A 4/1957 Sammis et al.
3,364,418 A 1/1968 MacCrea
3,573,609 A 4/1971 Vaher
3,781,656 A 12/1973 Glew
4,250,446 A * 2/1981 Ponte ..... 324/506
4,594,886 A 6/1986 Chen
4,713,617 A 12/1987 Michalski

* cited by examiner

*Primary Examiner*—N. Le
*Assistant Examiner*—James Kerveros
(74) *Attorney, Agent, or Firm*—Calfee, Halter & Griswold LLP

(57) ABSTRACT

A timing light for measuring timing of spark ignition has separate displays of engine RPM and timing advance. Another aspect of the invention provides a flashlight function which triggers the flash tube of the timing light to produce a constant bright light source for locating timing marks within an engine compartment. The flashlight function can be incorporated into a dual display digital timing light, or other timing light designs. A dedicated control on the timing light functions to place the flash tube in a continuous flashlight mode.

51 Claims, 3 Drawing Sheets

ENGINE TIMING MEASUREMENT DEVICE WITH RPM AND ADVANCE DISPLAYS AND FLASHLIGHT FUNCTION

FIELD OF THE INVENTION

The present invention pertains generally to electronic testing equipment and, more particularly, to electronic instruments for monitoring or measuring the performance of machinery such as internal combustion engines.

BACKGROUND OF THE INVENTION

Precise ignition timing and idle adjustments are essential in order to achieve maximum fuel economy and performance in internal combustion engines. Because timing changes with engine RPM and load, it is important to be able to measure timing not only at initial or base timing, as is done with a conventional timing light, but also to be able to measure timing advance, which is possible with digital timing lights and advance timing lights. Most engines require that both initial and advance timing calibrations be set or checked at specific engine RPMs, or in some cases with a specific vacuum applied to the vacuum advance diaphragm on the distributor, or in some cases by the vehicle's onboard computer. In the case of engines which are equipped with breaker point ignition systems, it will be necessary to set point dwell before adjusting timing.

Car manufacturers specify engine timing measured in degrees at certain engine speeds measured in RPM. Engine speed has to be maintained at a specified value for the timing reading to be valid. On a conventional digital timing light, the operator uses a switch to manually toggle a single display between the tachometer mode (reading engine RPM) and the timing mode (reading timing in degrees of advance).

Prior to beginning the timing check procedure, the stationary timing mark located on the engine must be found. On some engines, finding the timing mark is difficult or even impossible without a flashlight or some other source of light. Several timing light models available on the market have a small flashlight integrated into the case. The flashlight consists of an incandescent bulb, a lens, a bulb holder, an on/off switch, and some miscellaneous wires. The disadvantages of this design are that the light produced by the bulb is not very bright, the light bulb needs to be replaced periodically when it fails due to burning up or filament breakage due to a mechanical shock. Adding this feature also significantly increases the cost.

SUMMARY OF THE INVENTION

In the proposed design, the flash tube normally used to produce a strobe of light for engine timing measurements is also used to illuminate the engine compartment when looking for the timing marks. Depressing the flashlight button will interrupt the normal mode of operation and cause the flash tube to flash at a relatively high rate of approximately, for example, 25 Hz or higher regardless of the engine speed. At this high flashing rate, the human eye will perceive the light spot created by the flash tube and the lens in front of it as light essentially without flicker. When the flashlight button is released, the timing light switches back to normal mode of operation.

In a microcontroller or microprocessor controlled timing light, a flashlight on/off switch is required to add the flashlight feature of the invention. The software of a microcontroller or microprocessor controlled timing light generates a signal to trigger the flash tube at a relatively high rate to produce a light which is perceived by the human eye as continuous or constant. In other timing light designs, a flashlight on/off switch and a small circuit need to be added. This circuit will generate a square wave with a frequency of 25 Hz or higher to drive the flash-tube triggering circuit. The advantages of the new design are; brighter light (since the Xenon flash tubes produce brighter light than small incandescent bulbs); fewer parts, lower cost, and higher reliability since no additional parts are needed (light bulb, bulb holder, and lens, etc.).

A digital timing light with two displays simultaneously presenting engine speed and timing simplify the operation and allow to monitor engine speed constantly during the process of measuring the timing. This is especially useful for a one-person operation when a mechanic needs to manually operate the throttle with one hand to maintain proper engine speed, point the flashing light at the stationary and moving timing marks, operate the Increase and Decrease Advance switches, and read the displays. In accordance with several objects of the invention, there is provided a device for measuring and displaying information pertaining to the operation of a spark-ignited internal combustion engine, including a housing having a gripping portion and a pointing portion, a flash tube mounted within the pointing portion behind a lens at a distal end of the pointing portion, the flash tube electrically connected to a control circuit operative to sense electrical pulses from an engine and to control a triggering voltage supplied to the flash tube, a first display in the housing connected to the control circuit and operative to display a running speed of an engine, and a second display in the housing connected to the control circuit and operative to display an indication of timing of an engine.

BRIEF DESCRIPTION OF THE FIGURES

In the accompanying Figures

DETAILED DESCRIPTION OF THE INVENTION

Figure 1:
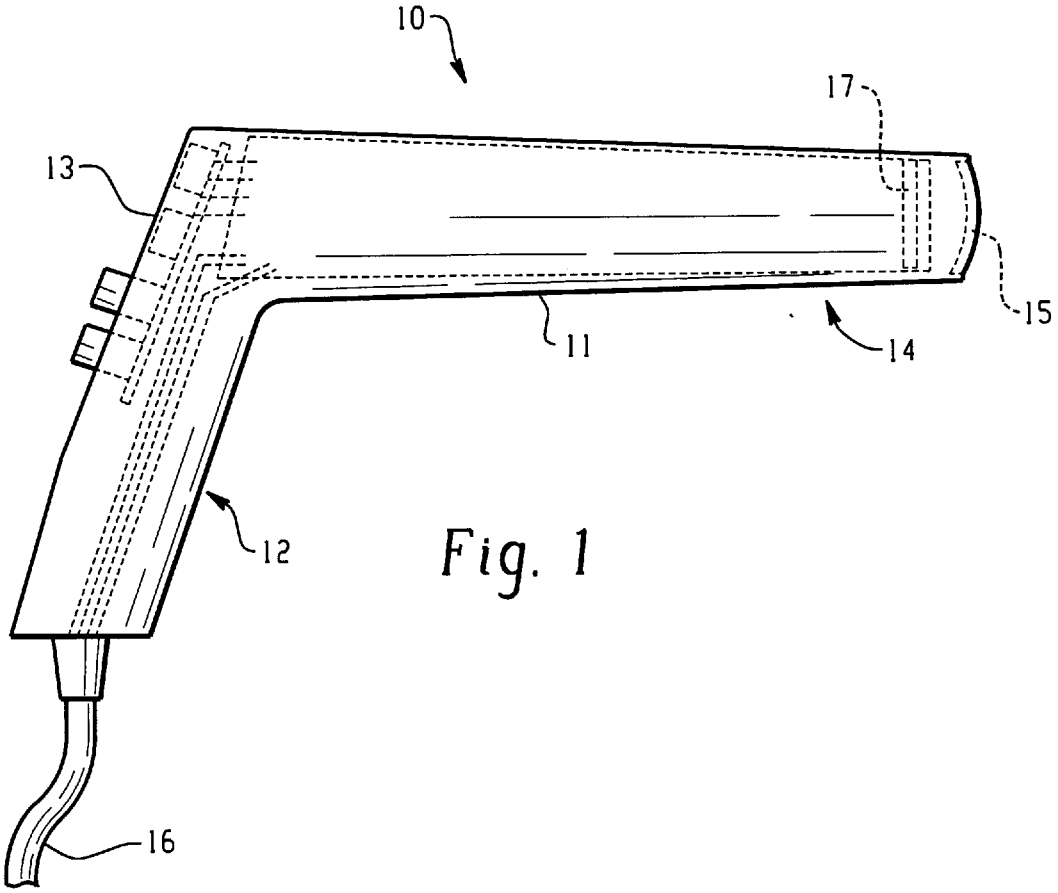
FIG. 1 is a elevation of an engine timing measurement device of the present invention.
Figure 2:
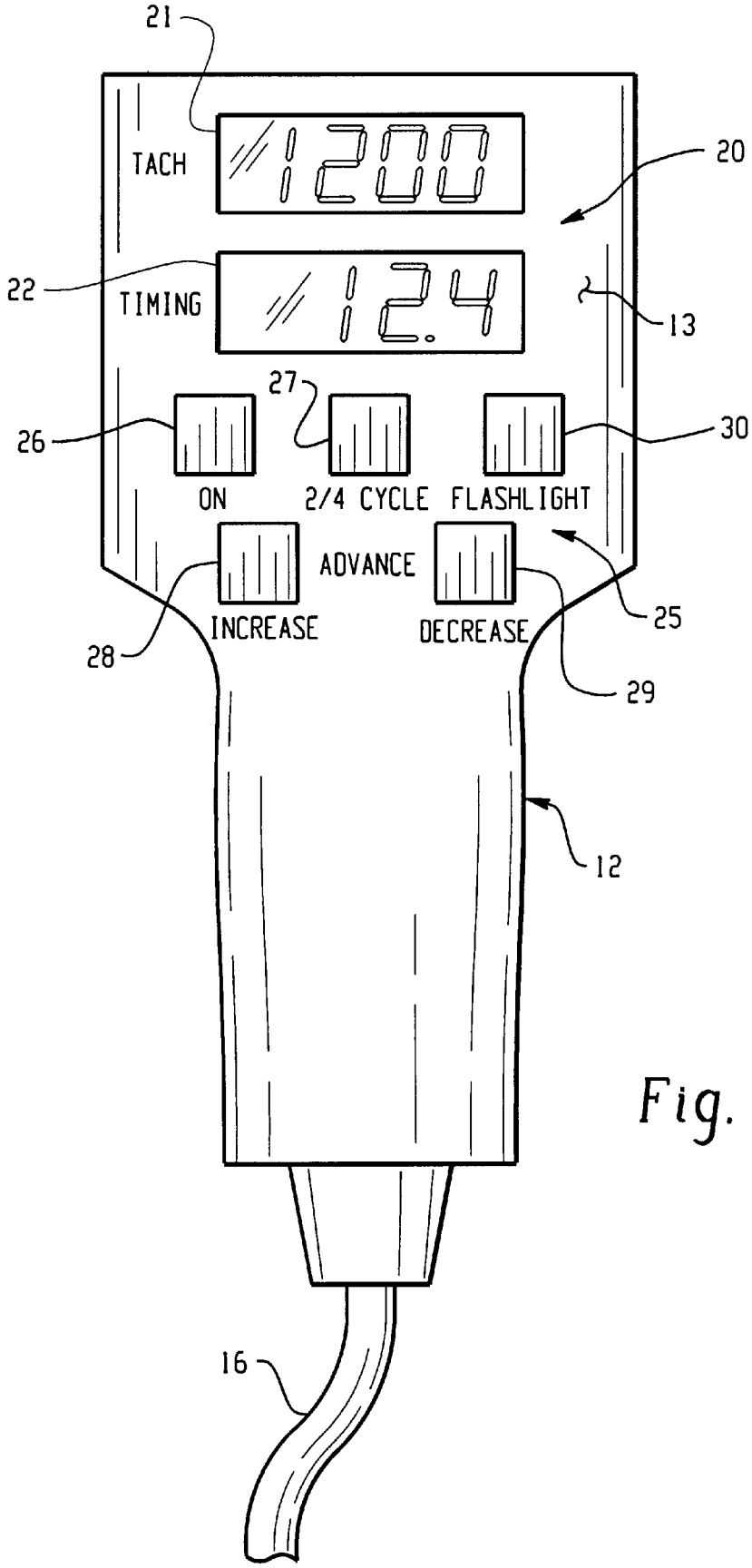
FIG. 2 is a rear elevation of an engine timing measurement device of the present invention.

With reference to FIGS. 1 and 2, there is shown a timing light device, indicated generally at 10. The device 10 has a housing 11 which includes an angular bend which forms a gripping portion 12 and a pointing portion 14. A lens 15 is mounted at the tip of pointing portion 14, and within the pointing portion behind lens 15 is mounted a light source, indicated generally at 17, such as an electrically energized lamp or flash tube, which is typically a Xenon charged vessel with integral electrodes connected to a power circuit. The power source to the lamp 17 is controlled by a control circuit described further herein and also located within the housing 11. An electrical cord 16, connected to the internal circuitry, exits from the gripping portion 12 of the housing 11 and terminates in battery connection clips and an inductive pick-up as is conventionally known.

As shown in FIG. 2, on a rear surface 13 of the gripping portion 12, is provided a dual display, indicated generally at 20, and a cluster of control buttons indicated generally at 25. The dual display includes a first display 21, and a second display 22. Each display may be, for example, a series of LEDs, LCDs, illuminated LCDs, or any other suitable means for displaying alpha-numeric information. In a preferred embodiment, the first display 21 is electronically configured to numerically indicate an operating RPM of an engine to which the device is connected. The second display is electronically configured to numerically indicate a measured timing of the engine, in degrees of advance. This dual display thus simultaneously displays both engine RPM and timing. This allows the user to monitor engine speed constantly during the process of measuring and adjusting the timing. For example, to measure and adjust the timing of an engine, the user must aim the timing light at a timing mark on the engine, set the engine RPM by throttle control, and read the timing advance indication of the device. With the dual display 20, the user does not have to toggle or switch between an RPM display or readout and a timing advance display in addition to the other tasks of controlling engine RPM and adjusting the timing.

To operate the device, the terminals of the electrical cord 16 are connected to a power source, such as a battery and ground, and the inductive lead about the number one spark plug wire. The device is powered up by depressing the ON button 26. Upon power-up the device displays engine RPM in the tachometer display which may be, for example, the first display 21. The unit may be configured to power-up in a 4 cycle mode, and can be toggled to a 2 cycle mode by operation of button 27. An advance timing indication is displayed in degrees in, for example, the second display 22. The advance is increased by depressing the increase button 28, and decreased by depressing the decrease button 29.

Figure 3:
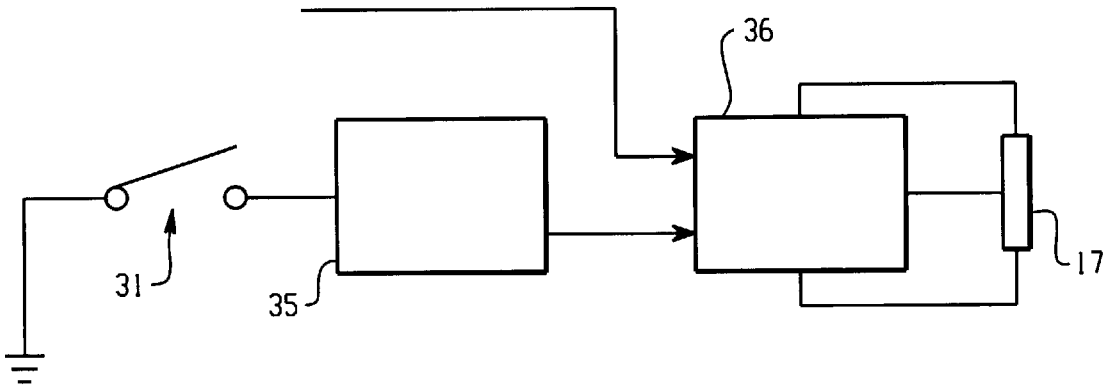
FIG. 3 is a block diagram of flashlight control circuitry of an engine timing measurement device of the present invention.

The control circuitry described herein generates a periodic trigger voltage to the flash tube in the device according to current signals picked up through the inductive lead of cable 16 and the preset value of timing advance. FIG. 3 schematically represents one type of circuit for triggering the flash tube at a high enough rate which will produce light perceived by the human eye as a continuous or constant light. The flashlight button 30, when depressed functions to apply pulses created by a square wave generator 35 (FIG. 3) to a flash tube power and triggering circuit 36 which in turn applies trigger pulses to the flash tube 17. In a preferred embodiment, the flash tube power and triggering circuit supplies a signal of, for example, approximately 25 Hz to the flash tube to produce a light which appears to the human eye as a continuous or constant light, in the manner of a flashlight. The brightness of a typical timing light flash tube, which is triggered at a high enough rate to produce what is perceived as a continuous light is generally much greater than the brightness of a battery powered flashlight with an incandescent light bulb. Therefore, the invention provides a superior light source useful for locating timing marks in engine compartments. As used herein, the term "continuous" refers to a light which appears to the human eye as a constant light source, even though the light may be flashing at a high rate.

Figure 4:
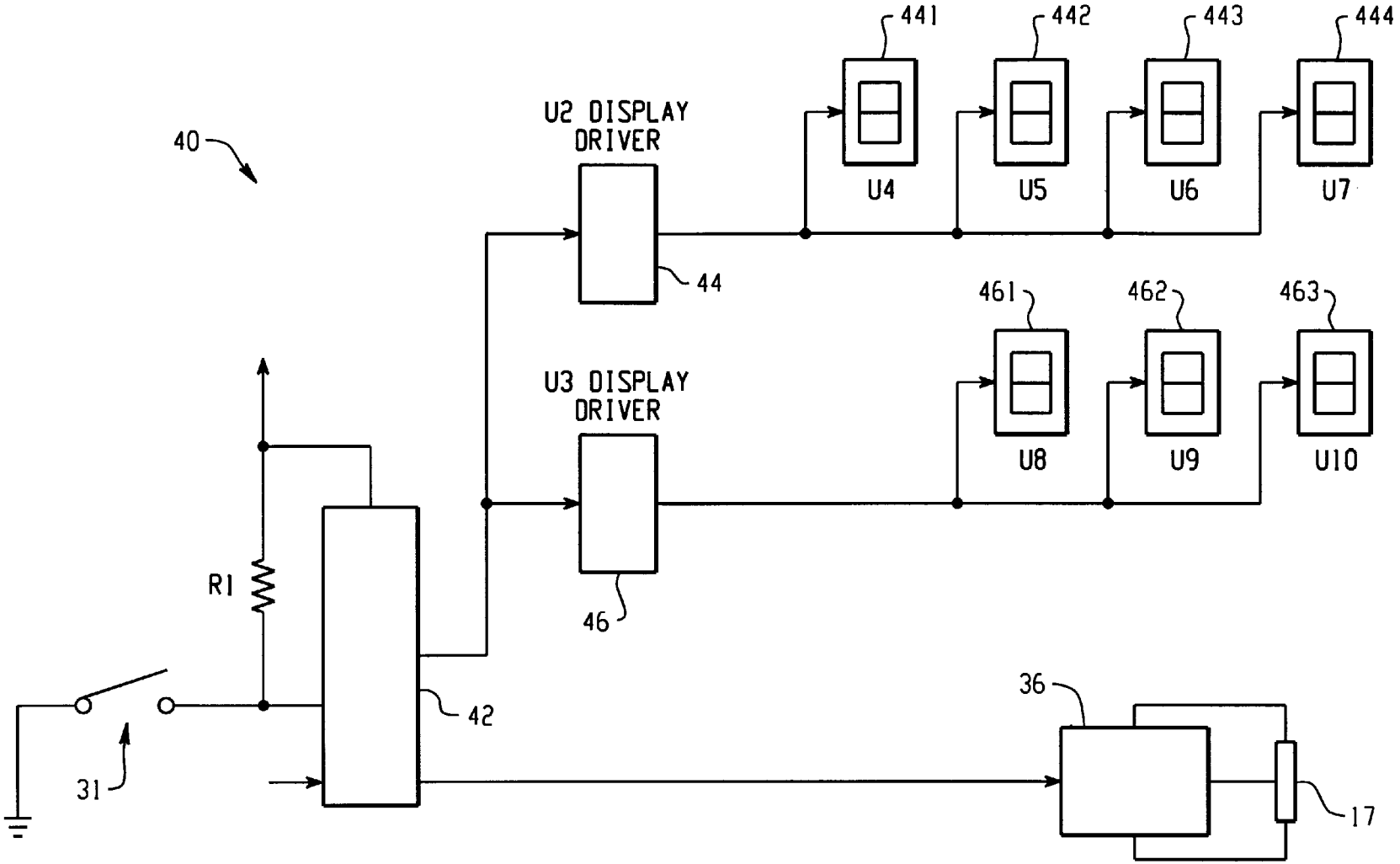
FIG. 4 is a block diagram of alternate flashlight and dual display control circuitry of an engine timing measurement device of the present invention.

FIG. 4 schematically illustrates certain components of a flashlight and dual display digital control circuit, indicated generally at 40, used in an alternate embodiment of the device 10, which also includes the dual tachometer and advance displays, and the flashlight function. In the circuit 40, the flash tube operation is controlled through a microprocessor or microcontroller 42, which also sends commands to separate display drivers 44 and 46 of LEDs or other suitable display means of the described first and second displays 21 and 22. For example, driver 44 is connected to four seven-segment LEDs 441, 442, 443 and 444 which together provide a four digit RPM tachometer display. Similarly, driver 46 is connected to three seven-segment LEDs 461, 462 and 463 which together provide a three digit degrees advance display to the tenths place.

The flashlight switch 31, actuated by button 30 as described above, switches an input of the microprocessor 42, which is programmed to generate an appropriate signal supplied to the flash tube power and triggering circuit 36 to trigger the flash tube at a sufficiently high frequency to produce a light source which appears continuous to the human eye. As mentioned above, the high frequency triggering of the flash tube produces a light perceived by the human eye to be continuous or constant, and which is much brighter than a conventional battery powered incandescent flashlight.

The invention thus provides an improved device for measuring and displaying information on the timing of a spark-ignited internal combustion engine, wherein information on engine speed and timing advance is continuously and simultaneously displayed during use of the device. The device further provides the convenience of a bright continuous light source for locating a timing mark on an engine by the flash tube of the device, thereby eliminating the need for a separate light source.

Although the invention has been described with reference to certain preferred and alternate embodiments, it will be appreciated that certain modifications and variations could be made by those of ordinary skill in the art which would fall within the scope of the invention as defined by the accompanying claims and equivalents thereto.

What is claimed as the invention is:

1. A device for measuring and displaying information pertaining to the operation of a spark-ignited internal combustion engine, the device comprising:

a housing having at least a pointing portion, a flash tube mounted within the pointing portion behind a lens at a distal end of the pointing portion, the flash tube electrically connected to a circuit operative to sense electrical pulses from an ignition system of an engine and operative to supply a triggering voltage to the flash tube, a first display in the housing connected to the circuit and operative to display a running speed of an engine, and a second display in the housing connected to the circuit and operative to display an indication of timing of an engine; and wherein said first and second displays simultaneously present engine speed and engine timing to a user and further wherein the display of engine speed on said first display is updated to permit the user to monitor engine speed constantly during a process of displaying information pertaining to the timing of the spark-ignited internal combustion engine.

2. The device of claim 1 wherein the circuit is a digital circuit, and the first and second displays are LED devices.

3. The device of claim 1 wherein the first and second displays are located closely adjacent in the housing.

4. The device of claim 1 wherein the circuit is a digital circuit which includes a microprocessor and LED displays, and display drivers connected to the LED displays.

5. The device of claim 1 further comprising a plurality of controls mounted within the housing and connected to the circuit and operative to control the triggering voltage supplied to the flash tube.

6. The device of claim 1 wherein the circuit is an analog circuit.

7. The device of claim 1 wherein the circuit functions in an alternative mode operative to supply a triggering voltage to the flash tube at a rate which causes the flash tube to generate light perceived by the human eye as continuous regardless of any pulses of the ignition system of the engine.

8. The device of claim 7 wherein the circuit in the alternative mode supplies a triggering voltage to the flash tube at a rate of 25 Hz or greater regardless of any pulses of the ignition system of the engine.

9. The device of claim 8 wherein said first display displays the running speed of the engine in numerical format and wherein said second display displays the indication of timing of the engine in numerical format.

10. The device of claim 8 wherein said first display displays the running speed of the engine in numerical format representing revolutions per minute and wherein said second display displays the indication of timing of the engine in numerical format representing degrees of advance.

11. The device of claim 1 wherein said first display displays the running speed of the engine in numerical format and wherein said second display displays the indication of timing of the engine in numerical format.

12. The device of claim 1 wherein said first display displays the running speed of the engine in numerical format representing revolutions per minute and wherein said second display displays the indication of timing of the engine in numerical format representing degrees of advance.

13. The device of claim 1 wherein the display of engine speed on said first display is updated to permit the user to monitor engine speed constantly during a process of measuring and adjusting the timing of the spark-ignited internal combustion engine.

14. A timing light device for assisting a user in measuring the timing of a spark-ignited engine, the timing light comprising:

a housing in which is mounted a light source, and an opening in the housing through which light generated by the light source is directed, a circuit in the housing connected to the light source and operative to control operation of the light source, means for electrically connecting the circuit to an ignition system of a spark-ignited engine, at least two displays mounted within the housing and connected to the circuit, one display operative to display a running speed of the spark-ignited engine, and another display operative to display an indication of a timing advance of the spark-ignited engine, and controls mounted to be accessible from an exterior of the housing and operatively connected to the circuit; and wherein said at least two displays simultaneously present engine speed and engine timing to a user and further wherein the display of engine speed is updated to permit the user to monitor engine speed constantly during a process of displaying information pertaining to the timing of the spark-ignited internal combustion engine.

15. The timing light device of claim 14 wherein the circuit is a digital circuit which includes a microprocessor or a microcontroller, a display driver for each display, and a light source triggering circuit, and wherein the displays are digital displays.

16. The timing light device of claim 14 wherein the controls include manipulable elements operative to control power to the device, and operative to control operation of the light source.

17. The timing light of claim 14 wherein the controls include a dedicated control operative to control the light source to produce light perceived by the human eye as continuous.

18. The device of claim 17 wherein the dedicated control is operative to control the light source to produce light at a rate of 25 Hz or greater.

19. The device of claim 17 wherein the running speed of the engine is displayed in numerical format and wherein the indication of timing of the engine is displayed in numerical format.

20. The device of claim 17 wherein the running speed of the engine is displayed in numerical format representing revolutions per minute and wherein the indication of timing of the engine is displayed in numerical format representing degrees of advance.

21. The timing light of claim 14 wherein the displays are proximately arranged within the housing.

22. The timing light of claim 14 wherein the controls are proximately arranged relative to the displays.

23. The timing light of claim 14 wherein the controls include a dedicated control operative to control the light source to produce light at a rate of 25 Hz or greater.

24. The device of claim 23 wherein the running speed of the engine is displayed in numerical format and wherein the indication of timing of the engine is displayed in numerical format.

25. The device of claim 23 wherein the running speed of the engine is displayed in numerical format representing revolutions per minute and wherein the indication of timing of the engine is displayed in numerical format representing degrees of advance.

26. The device of claim 14 wherein the display of engine speed is updated to permit the user to monitor engine speed constantly during a process of measuring and adjusting the timing of the spark-ignited internal combustion engine.

27. The device of claim 14 wherein the running speed of the engine is displayed in numerical format and wherein the indication of timing of the engine is displayed in numerical format.

28. The device of claim 14 wherein the running speed of the engine is displayed in numerical format representing revolutions per minute and wherein the indication of timing of the engine is displayed in numerical format representing degrees of advance.

29. A digital timing light selectively operating in a flashlight mode to locate a timing mark on an engine, the timing light comprising:

a housing in which is mounted a flash tube and an opening in the housing through which light generated by the flash tube is directed, a circuit also mounted within the housing and electrically connected to the flash tube to provide a trigger voltage to the flash tube, the circuit also including a microprocessor programmed to apply voltage signals to the flash tube at frequencies related to a rate of operation of an engine to which the timing light is electrically connected, the circuit further programmed to apply voltage signals to the flash tube by which the flash tube produces a light perceived by the human eye as being a continuous light so that the timing light can be used as a flashlight.

30. A timing light device for use in testing an internal combustion engine, comprising:

a housing;

a flash tube mounted within said housing and providing flashes of light external to said housing responsive to a triggering voltage;

a control circuit receiving an input related to the functioning of the internal combustion engine, said control circuit selectively providing a triggering voltage to said flash tube at a rate based on the input related to the functioning of the internal combustion engine; and a dual display in said housing connected to said control circuit, said dual display simultaneously displaying engine speed and engine timing to a user; and wherein the display of engine speed on said first display is updated to permit the user to monitor engine speed constantly during a process of displaying information pertaining to the timing of the internal combustion engine.

31. The device of claim 30 wherein the display of engine speed is updated to permit the user to monitor engine speed constantly during a process of measuring and adjusting the timing of the internal combustion engine.

32. The device of claim 30 wherein said control circuit functions in at least two alternative modes:

a first mode in which said control circuit provides a triggering voltage to said flash tube at a rate based on the input related to the functioning of the internal combustion engine; and a second, flashlight mode in which said control circuit provides a triggering voltage to said flash tube at a rate of 25 Hz or greater, regardless of the input related to the functioning of the internal combustion engine.

33. A timing light device according to claim 32, wherein while in the second, flashlight mode, said control circuit provides a triggering voltage to said flash tube at a rate which causes the flash tube to generate light perceived by the human eye as being continuous, regardless of the input related to the functioning of the internal combustion engine.

34. The timing light device of claim 32 further comprising a dedicated control operative to cause said control circuit to function in the second, flashlight mode.

35. The timing light device of claim 33 further comprising a dedicated control operative to cause said control circuit to function in the second, flashlight mode.

36. A timing light device for use in testing an internal combustion engine, comprising:

a housing;

a light source mounted within said housing and providing flashes of light external to said housing responsive to a control signal;

a control circuit receiving an input related to the functioning of the internal combustion engine, said control circuit selectively providing the control signal to said light source at a rate based on the input related to the functioning of the internal combustion engine; and a dual display in said housing connected to said control circuit, said dual display simultaneously displaying engine speed and engine timing to a user; and wherein the display of engine speed on said first display is updated to permit the user to monitor engine speed constantly during a process of displaying information pertaining to the timing of the internal combustion engine.

37. The device of claim 36 wherein the display of engine speed is updated to permit the user to monitor engine speed constantly during a process of measuring and adjusting the timing of the internal combustion engine.

38. The device of claim 36 wherein said control circuit functions in at least two alternative modes:

a first mode in which said control circuit provides the control signal to cause said light source to flash at a rate based on the input related to the functioning of the internal combustion engine; and a second, flashlight mode in which said control circuit provides the control signal to cause said light source to flash at a rate of 25 Hz or greater, regardless of the input related to the functioning of the internal combustion engine.

39. A timing light device according to claim 38, wherein while in the second, flashlight mode, said control circuit provides the control signal to said light source at a rate which causes the light source to generate light perceived by the human eye as being continuous, regardless of the input related to the functioning of the internal combustion engine.

40. The timing light device of claim 38 further comprising a dedicated control operative to cause said control circuit to function in the second, flashlight mode.

41. The timing light device of claim 39 further comprising a dedicated control operative to cause said control circuit to function in the second, flashlight mode.

42. A timing light device for use in testing an internal combustion engine and selectively operating in a flashlight mode by providing light perceived by the human eye as being continuous, comprising:

a housing;

a light source mounted within said housing and providing flashes of light external to said housing responsive to a control signal; and a control circuit receiving an input related to the functioning of the internal combustion engine, said control circuit selectively providing the control signal to said light source, and said control circuit functioning in at least two alternative modes:

a first mode in which said control circuit provides the control signal to cause said light source to flash at a rate based on the input related to the functioning of the internal combustion engine; and a second, flashlight mode in which said control circuit provides the control signal to cause said light source to flash at a rate of 25 Hz or greater, regardless of the input related to the functioning of the internal combustion engine.

43. A timing light device according to claim 42, wherein while in the second, flashlight mode, said control circuit provides a control signal to said light source at a rate which causes the light source to generate light perceived by the human eye as being continuous, regardless of the input related to the functioning of the internal combustion engine.

44. The timing light device of claim 42 further comprising a dedicated control operative to cause said control circuit to function in the second, flashlight mode.

45. The timing light device of claim 43 further comprising a dedicated control operative to cause said control circuit to function in the second, flashlight mode.

46. A timing light device for use in testing an internal combustion engine and selectively operating in a flashlight mode by providing light perceived by the human eye as being continuous, comprising:

a housing;

a light source mounted within said housing and providing flashes of light external to said housing responsive to a control signal; and a control circuit receiving an input related to the functioning of the internal combustion engine, said control circuit selectively providing the control signal to said light source, and said control circuit functioning in at least two alternative modes:

a first mode in which said control circuit provides the control signal to cause said light source to flash at a rate based on the input related to the functioning of the internal combustion engine; and a second, flashlight mode in which said control circuit causes said light source to generate light perceived by the human eye as being continuous, regardless of the input related to the functioning of the internal combustion engine.

47. The timing light device of claim 46 further comprising a dedicated control operative to cause said control circuit to function in the second, flashlight mode.

48. A timing light device for use in testing an internal combustion engine and selectively operating in a flashlight mode by providing light perceived by the human eye as being continuous, comprising:

a housing;

a flash tube mounted within said housing and providing flashes of light external to said housing responsive to a triggering voltage; and a control circuit receiving an input related to the functioning of the internal combustion engine, said control circuit selectively providing a triggering voltage to said flash tube, and said control circuit functioning in at least two alternative modes:

a first mode in which said control circuit provides a triggering voltage to said flash tube at a rate based on the input related to the functioning of the internal combustion engine; and a second, flashlight mode in which said control circuit provides a triggering voltage to said flash tube at a rate of 25 Hz or greater, regardless of the input related to the functioning of the internal combustion engine.

49. A timing light device according to claim 48, wherein while in the second, flashlight mode, said control circuit provides a triggering voltage to said flash tube at a rate which causes the flash tube to generate light perceived by the human eye as being continuous, regardless of the input related to the functioning of the internal combustion engine.

50. The timing light device of claim 48 further comprising a dedicated control operative to cause said control circuit to function in the second, flashlight mode.

51. The timing light device of claim 49 further comprising a dedicated control operative to cause said control circuit to function in the second, flashlight mode.

* * * * *